US006722876B2

(12) United States Patent
Abraham et al.

(10) Patent No.: US 6,722,876 B2
(45) Date of Patent: Apr. 20, 2004

(54) FLAMMABLE VAPOR CONTROL SYSTEM

(75) Inventors: Anthony W. Abraham, Laguna Nigel, CA (US); Dwain Moore, Fort Collins, CO (US); John Paisley, Waterloo (CA); Xiangsheng Wang, Guelph (CA)

(73) Assignee: The Water Heater Industry Joint Research and Development Consortium, Rio Verde, AZ (US)

( * ) Notice: Subject to any disclaimer, the term of this patent is extended or adjusted under 35 U.S.C. 154(b) by 321 days.

(21) Appl. No.: 09/826,644

(22) Filed: Apr. 4, 2001

(65) Prior Publication Data

US 2001/0038986 A1 Nov. 8, 2001

Related U.S. Application Data

(60) Provisional application No. 60/195,829, filed on Apr. 11, 2000.

(51) Int. Cl.[7] ..... F22B 37/42

(52) U.S. Cl. ..... 431/22; 431/6; 122/504

(58) Field of Search ..... 431/22, 6; 122/504, 122/14.21; 137/456; 340/632; 73/23.31

(56) References Cited

U.S. PATENT DOCUMENTS

| | | | | | |
|---|---|---|---|---|---|
| 3,045,198 | A | * | 7/1962 | Dolan et al. | 338/13 |
| 4,129,030 | A | * | 12/1978 | Dolan | 340/632 |
| 4,334,258 | A | * | 6/1982 | Seeman et al. | 431/22 |
| 4,663,958 | A | | 5/1987 | Matthiessen | |
| 4,925,386 | A | | 5/1990 | Donnelly et al. | |
| 5,364,260 | A | | 11/1994 | Moore | |
| 5,540,273 | A | * | 7/1996 | Polk et al. | 431/22 |
| 5,797,358 | A | * | 8/1998 | Brandt et al. | 431/22 |
| 5,969,623 | A | * | 10/1999 | Fleury et al. | 73/23.31 |
| 6,139,311 | A | * | 10/2000 | Bowman et al. | 431/22 |
| 2002/0134322 | A1 | * | 9/2002 | Dolan | 122/504 |

* cited by examiner

*Primary Examiner*—Sara Clarke
(74) *Attorney, Agent, or Firm*—Konneker & Smith, P.C.

(57) ABSTRACT

A safety device for shutting off the flow of gas to a gas-fired appliance in the presence of flammable vapors. The resistance of a variable resistance flammable vapor sensor is monitored by a microprocessor that controls the operation of a gas flow valve. When the measured resistance indicates the presence of a preselected concentration of flammable vapors, the gas flow valve is shut of and the ignition system cannot be energized.

9 Claims, 1 Drawing Sheet

FLAMMABLE VAPOR CONTROL SYSTEM

This application claims the benefit of U.S. Provisional Application No.: APPLICATION No. 60/195,829 FILING DATE Apr. 11, 2000.

BACKGROUND OF THE INVENTION

The present invention generally relates to safety devices for mitigating the danger posed by the presence of flammable vapors in proximity to a gas-burning appliance and more particularly pertains to a control system that shuts down the operation of the appliance when the presence of flammable vapors is detected.

A potential hazard inherent in the operation of a gas-burning appliance is that it may cause flammable vapors to ignite that happen to collect in and around the appliance. Ignition may either be caused by the burner or pilot flame or by an electric or electronic ignitor upon being energized. This is especially problematic in for example water heaters or furnaces that are located in garages in which cars are parked where the leakage or spillage of gasoline may occur. Once a combustible mixture reaches the appliance, a fire or explosion may result.

Efforts to address this potential safety hazard have been previously directed to ensuring adequate ventilation in and around the appliance, the elevation of the appliance in an effort to distance it from flammable vapors that are denser than air, and more recently, the isolation or sealing of the burner from its surroundings. Attempts have also previously been made to adapt specialized sensors for the purpose of sounding an alarm in the event the presence of certain flammable vapors is detected. Such systems are however incapable of automatically and positively preventing the ignition of flammable vapors by a gas-fired appliance. Moreover, a gas-fired appliance that relies on an automatic ignition system poses an additional hazard as merely shutting off the supply of gas so as to extinguish the burner would not necessarily preclude ignition by an electronic or electric ignitor should it subsequently become energized.

A flammable vapor control system is needed that is able to mitigate the danger of a gas-burning appliance that employs an automatic ignition system so as positively prevent such appliance from igniting flammable vapors. Such system must be capable of reliably removing all potential ignition sources once a certain concentration of flammable vapors has been detected.

SUMMARY OF THE INVENTION

The present invention overcomes shortcomings of previously known approaches for mitigating the dangers associated with a gas-burning appliance. By employing a microprocessor that controls the operation of a gas appliance both in terms of regulating the flow of gas to the appliance as well as controlling the operation of the ignition system, a system is provided that positively precludes the ignition of flammable vapors by the appliance. The microprocessor is responsive to a sensor that is capable of detecting the presence of flammable gases. Once a sufficient concentration of flammable vapor is detected, the flow of gas to the appliance is shut off to extinguish both the burner as well as an associated pilot flame if present, and if the appliance employs a hot surface igniter or spark igniter, the ignition system is de-energized. By causing the microprocessor to respond to a concentration of flammable vapors well below a combustible concentration, a substantial margin of safety is automatically built into the system.

The system may additionally control the operation of an induced draft fan that is activated whenever the gas valve is energized and may additionally be activated during a pre-purge or post-purge cycle to clear the combustion chamber of any flammable vapors The flammable vapor sensor is connected to the microprocessor through suitable interface circuits. The sensor changes resistance as a function of the presence of flammable vapors wherein the resistance increases along with an increase in the vapor concentration. The microprocessor measures the resistance of the sensor and the response is triggered at a preselected resistance. The system is readily adaptable to a variety of gas-fired appliances including, but not limited to, furnaces and water heater systems.

More particularly, the present invention provides for the interconnection of a flammable vapor sensor to a microprocessor having an internal analog-to-digital converter. The control will monitor the resistance of the sensor, and when it detects the presence of a preselected concentration of flammable vapors, the controller will de-energize both the gas valve and the ignition source. The controller may monitor the sensor resistance at all times or it may alternatively, only at the beginning and during an ignition cycle. Another optional feature includes the ability to lock out at a given vapor in a volatile lockout which would require the removal and subsequent re-application of power. As a further alternative, a non-volatile lockout can be employed which cannot be reset by simply removing and re-applying power. Such feature may be used in combination with the volatile lockout wherein the non-volatile lockout becomes active after resetting the volatile lockout a predetermined number of times. As a further alternative, the system may include a fuse which blows when a predetermined level of flammable vapors is sensed by the sensor.

These and other features and advantages of the present invention will become apparent from the following detailed description of a preferred embodiment which, taken in conjunction with the accompanying drawings, illustrates by way of example the principles of the invention.

DETAILED DESCRIPTION OF THE PREFERRED EMBODIMENTS

The drawings depict various embodiments of the present invention wherein a microprocessor controls the operation of the gas-burning appliance. When the flammable vapor sensor detects a predetermined level of flammable vapors, the microprocessor shuts off the flow of gas to the appliance and prevents energization of the ignition system. The extinction of the appliance's burner and the denial of power to the ignition system serves to positively remove the appliance as a possible ignition source for the flammable vapors.

Figure 1:
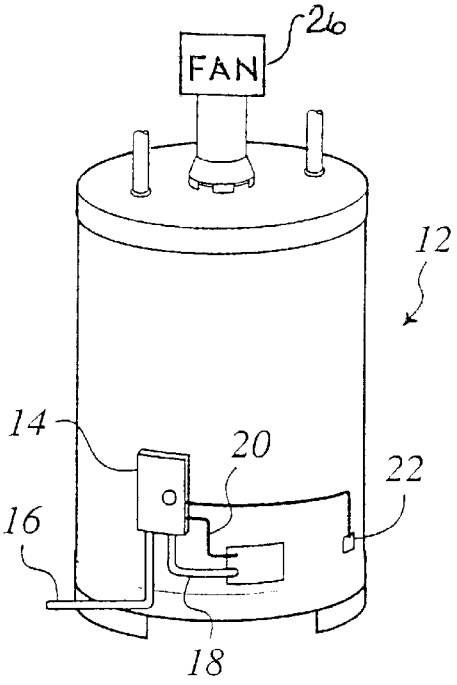
FIG. 1 is a schematic illustration of a water heater employing the safety system of the present invention.

FIG. 1 is an illustration of a water heater employing the safety system of the present invention. A water heater 12 employs a gas control unit 14 which serves to control the flow of gas from an inlet conduit 16 to a feedline 18 that supplies a burner within the water heater. Additionally, electrical conductors 20 associated with a thermocouple or thermopile and electric or electronic ignition system extend from the control unit to within the water heater. A flammable vapor sensor 22 is situated near the base of the water heater as many flammable vapors of concern, such as gasoline, are heavier than air. Alternatively, the sensor maybe positioned directly in an intake duct through which combustion air is routed to the water heater's burner.

Contained in the control unit, is a microprocessor that interfaces with a gas valve as well as an ignition system. Whenever an increase in the temperature of the water contained within the water heater is called for, the control unit causes the valve to be opened, so as to supply gas to the burner, and the ignition system to be energized. After the gas issuing from the burner has been ignited, the ignition system is de-energized while the gas continues to flow until a desired water temperature within the water heater has been attained. Such systems are well known in the art and many variations thereof are possible.

Figure 2:
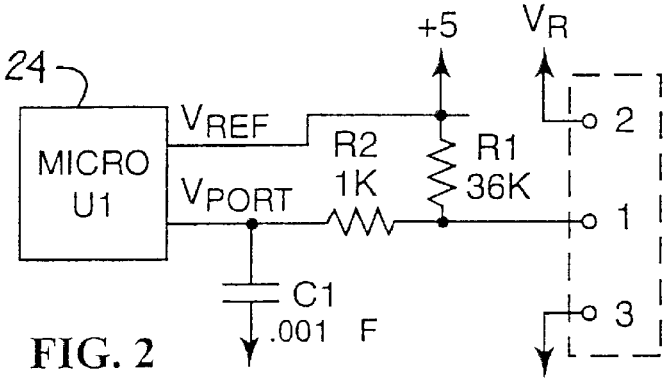
FIG. 2 is circuit diagram including a microprocessor.

Referring first to the main circuit diagram depicted in FIG. 2, the micro port pin extending from microprocessor 24 (U1, Vport) is configured as an analog-to-digital converter (A/D), and reads the voltage of the divider between a preferably variable resistance sensor device (R3) and a (preferably) fixed resistance, which may be for example a 36 K ohm resistor (R1). The reference voltage of the A/D (Vref of U1) is the same as the voltage on the opposite side of the 36 K resistor (R1). R2 and C1 create a simple RC time delay to filter any electrical noise. Additional filtration may be added if needed.

Figure 3:
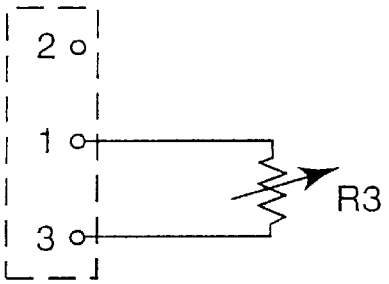
FIG. 3 is a circuit diagram of the sensor.

Referring now to sensor circuit depicted in FIG. 3, if a variable resistance flammable vapor sensing device (R3) increases in value to, for example, 10 Kohm, when vapors are present, the voltage on the divider (R1 and R3) will be approximately 1.0 V or higher. If the voltage (U1, Vport) is below 0.07 V, or the variable resistance flammable vapor sensor (R3) is below a preselected value, which may for example be 500 ohms, the control will also lock out. This serves to detect if the sensor has been bypassed, as for example, if it has been replaced by a wire.

Figure 4:
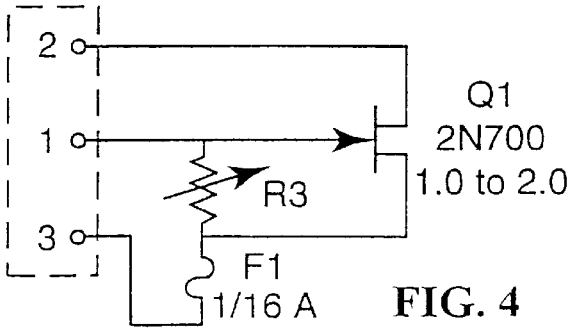
FIG. 4 is a circuit diagram of an alternative embodiment of the sensor.

Referring now to sensor circuit depicted in FIG. 4, the circuit generally works in the same manner as above, except for the addition of a fuse (F1) and the FET (Field Effect Transistor) (Q1). A 2N7008 or the like may be used as Q1. If the gate of the FET (Q1) rises above the on voltage, the FET (Q1) will switch on and create a large current between Vr and GND through the fuse (F1). This will cause the fuse to blow open. The on voltage of this FET, a 2N7008, is generally between 1.0 and 2.5 VDC. To ensure that the fuse blows at the same time the control locks out, the micro port pin (U1, Vport) changes from an A/D input to an I/O output pin. The output will be high, approximately 5V. This will force the gate of the FET (Q1) above the on voltage, and will blow the fuse (F1) at the same time the control locks out.

Any of a variety of flammable vapor sensors may be employed. The resistance of such sensor preferably increases as a function of the flammable vapor concentration. An example of such device is the ADSISTOR VAPOR SENSOR #303-A that is supplied by ADSISTOR TECHNOLOGY, INC of Seattle, Wash. Such device has a resistance of 1 K-ohm to 3 K-ohm at 70° F. in the absence of the flammable vapors. Upon exposure to 50% of the LFL (low flammability level), the sensor's resistance will exceed 10 K-ohms preferably within about 30 seconds.

The microprocessor circuits may be set up to shut off the flow of gas and to preclude the energization of the ignition system at any preselected concentration of flammable vapors. In order to impart a substantial margin of safety to the system, it may be desirable to shut of the flow of gas when a 50% LFL (low flammability level) or LEL (low explosive level) is achieved. Additionally, the rate of the increase in the concentration of the flammable vapor may be monitored and the time at which a critical concentration will achieved may be estimated so that the gas may be shut off before the delayed response time of the sensor would otherwise cause the shut off of the gas. This allows the gas to be shut off and/or the ignition system to be de-activated much sooner than would be possible in view of the 30 second response time provided by the particular sensor described above.

The microprocessor may additionally be configured to provide for a volatile lockout which can only be reset by briefly removing and re-applying power to the device. Alternatively, the lockout may be non-volatile wherein a power interruption would not result in a reset. It may be especially preferable to combine a volatile lockout with a non-volatile lockout, wherein the non-volatile mode would become applicable after predetermined number of attempts to reset the volatile lockout. Other lockout systems well known in the art may be incorporated in the safety system of the present invention.

The safety system of the present invention may additionally be adapted to a gas-fired appliance that includes an induced draft fan, such as the fan 26 schematically depicted in FIG. 1 on the water heater 12, and the associated ducting. The microprocessor used in conjunction with such system may be configured to cause the induction fan to blow after the gas supply has been shut off to thereby blow exhaust gases away from the combustion chamber.

The microprocessor may be configured to monitor the sensor resistance at all times or it may monitor its resistance at a predetermined time such as just prior to and during an ignition cycle. Monitoring would therefore not occur when no heating of the contents of the water heater is called for.

While a particular form of the invention has been illustrated and described, it will also be apparent to those skilled in the art that various modifications can be made without departing from the spirit and scope of the invention. More particularly, the system may be adapted to any of a variety of different gas-fired appliances and any of a variety of different variable resistance flammable vapor sensors may be used. Accordingly, it is not intended that the invention be limited except by the appended claims.

What is claimed is:

1. A safety system for controlling a burner of a gas appliance, comprising:

a gas valve for controlling the flow of gas to said burner;

a sensor operative to detect a flammable vapor; and a microprocessor responsive to said sensor and operative to shut off the gas valve when a preselected concentration of flammable vapors is detected, the microprocessor monitoring said sensor only at the beginning of and during an ignition cycle.

2. A safety system for controlling a burner of a gas appliance, comprising:

a gas valve for controlling the flow of gas to said burner;

a sensor operative to detect a flammable vapor;

a microprocessor responsive to said sensor and operative to shut off the gas valve when a preselected concentration of flammable vapors is detected; and an electronic ignitor wherein said microprocessor is further operative to preclude the energization of said ignitor of said ignitor when preselected level of flammable vapors is sensed by said sensor.

3. The safety system of claim 2, wherein the microprocessor monitors said sensor at all times.

4. The safety system of claim 2, wherein the microprocessor monitors said sensor only at the beginning and during the ignition cycle.

5. A safety system for controlling a burner of a gas appliance, comprising:

a gas valve for controlling the flow Of gas to said burner;

a sensor operative to detect a flammable vapor; and a microprocessor responsive to said sensor and operative to shut off the gas valve when a preselected concentration of flammable vapors is detected, the microprocessor having an internal analog-to-digital converter to which said vapor sensor is connected, said sensor being incorporated in a voltage divider circuit.

6. A safety system for controlling a burner of a gas appliance, comprising:

a gas valve for controlling the flow of gas to said burner;

a sensor operative to detect a flammable vapor; and a microprocessor responsive to said sensor and operative to shut off the gas valve when a preselected concentration Of flammable vapors is detected, the microprocessor having an internal analog-to-digital converter to which said vapor sensor is connected, a filter circuit being disposed between said sensor and said microprocessor to filter electrical noise.

7. A safety system for controlling a burner of a gas appliance, comprising:

a gas valve for controlling the flow of gas to said burner;

a sensor operative to detect a flammable vapor; and a microprocessor responsive to said sensor and operative to shut off the gas valve when a preselected concentration of flammable vapors is detected, the microprocessor having an internal analog-to-digital converter to which said vapor sensor is connected, a fuse being combined with said sensor and being adapted to blow when the vapor concentration reaches the preselected concentration.

8. The safety system of claim 7, wherein a FET is relied upon to cause said fuse to blow when said vapor concentration reaches the preselected concentration.

9. A safety system for controlling a burner of a gas appliance, comprising:

a gas valve for controlling the flow of gas to said burner;

a sensor operative to detect a flammable vapor;

a microprocessor responsive to said sensor and operative to shut off the gas valve when a preselected concentration Of flammable vapors is detected; and an induced draft fan, wherein said microprocessor is operative to energized said fan at times when said valve is closed.

* * * * *